US005426402A

United States Patent [19]

Mariani

[11] Patent Number: 5,426,402

[45] Date of Patent: Jun. 20, 1995

[54] PRESELECTOR FILTER WITH TUNABLE NARROWBAND EXCISION

[75] Inventor: Elio A. Mariani, Hamilton Square, N.J.

[73] Assignee: The United States of America as represented by the Secretary of the Army, Washington, D.C.

[21] Appl. No.: 293,007

[22] Filed: Aug. 19, 1994

[51] Int. Cl.[6] ..... H01P 1/203; H01P 1/217

[52] U.S. Cl. ..... 333/205; 333/246

[58] Field of Search ..... 333/204, 205, 219, 246, 333/235, 219.1

[56] References Cited

U.S. PATENT DOCUMENTS

| | | | |
|---|---|---|---|
| H000,432 | 2/1988 | Mariani et al. | 333/235 X |
| 3,753,167 | 8/1973 | Cohn | 333/204 X |
| 4,297,661 | 10/1981 | Stegens | 333/204 |
| 5,142,255 | 8/1992 | Chang et al. | 333/219 X |

*Primary Examiner*—Seungsook Ham

*Attorney, Agent, or Firm*—Michael Zelenka; James A. DiGiorgio

[57] ABSTRACT

A planar preselector filter with tunable narrowband excision composed of a ferrite substrate having a microstrip line with a fixed-tuned bandpass filter on one surface and a plurality of slotline resonators etched in a ground plane on an opposing surface. The fixed tuned bandpass filter is composed of short resonant elements of microstrip, having a length that is one-half the guide wavelength at the center frequency of its passband. The slotline resonators are positioned on the opposing surface of the substrate such that it suppresses or excises a predetermined narrowband of frequencies within the passband of the fixed-tuned bandpass filter. Moreover, the center frequency of the narrowband excision is varied by applying a tunable magnetic bias field of a predetermined strength across the ferrite substrate.

4 Claims, 1 Drawing Sheet

PRESELECTOR FILTER WITH TUNABLE NARROWBAND EXCISION

GOVERNMENT INTEREST

The invention described herein may be manufactured, used, and licensed by or for the Government for governmental purposes without the payment to me of any royalties thereon.

FIELD OF INVENTION

The invention relates to microwave and millimeter-wave filters, and more specifically to a low-cost, tunable planar preselector circuit having the capability to rapidly excise any signal within the passband via a magnetically-tunable slot-line filter.

BACKGROUND OF THE INVENTION

Heretofore, electrical filters have been widely used to control the flow of electrical signals that travel through a circuit. In receiver front-ends, preselector filters have been used to pass frequencies associated with a particular channel and to reject other frequencies before they pass to the receiver. Such preselector filters have been designed to control bandwidths ranging from a fraction of a hertz in control systems, to 3 kilohertz in telephone systems, to 20 kilohertz in AM radio systems, to 6 megahertz in television systems.

In microwave and millimeter-wave applications, planar microwave filter structures such as microstrip bandpass filters and stripline filters have been used to achieve such electrical filter functions. Microstrip filters are formed by etching a circuit pattern on one side of two metal layers separated by a dielectric substrate. Stripline filters, on the other hand, are formed by etching a circuit pattern on a metal layer that is sandwiched between two dielectric slabs, each having an outer surface covered by a metal ground plane. To achieve electrical filtering in such microstrip and stripline systems, the circuit pattern etched on their respective metal layers is essentially a series or array of resonant metallic elements. These metallic elements have a length that is one-half the guide wavelength at the center frequency of the passband of the preselector filter. Moreover, the resonant elements are spaced in relation to one another such that only the frequencies within the passband pass through the stripline or microstrip circuit. As a result, the circuit pattern etched in the microstrip or stripline acts as a wideband fixed-tuned bandpass filter.

In some RF applications, however, there is often a need to reject or excise a selected frequency or a narrowband of frequencies within the passband which are considered interference. In an effort to reduce or eliminate these undesirable frequencies, tunable notch filters were developed. One such notch filter, using an yttrium-iron-garnet (hereinafter YIG) resonator (i.e. sphere), was developed to enable a receiver to reject any frequency within the passband of the microwave or millimeter-wave system front-end.

These YIG filters, however, are not planar devices and thus are not compatible with microwave and millimeter-wave integrated circuitry. Moreover, RF connectors must be mounted to the YIG filter housing. As a result, discrete magnetically-tunable YIG filters can be costly and bulky when utilized in microwave or millimeter wave systems as preselector circuits.

SUMMARY OF THE INVENTION

Accordingly, the present invention provides a low-cost, tunable, planar preselector filter configuration having the capability to rapidly excise any signal within the passband of a microwave or millimeter-wave circuit via a magnetically-tunable notch. To attain this, the present invention provides a microstrip having a fixed-tuned wideband bandpass filter connected in series with a magnetically tunable band-rejection slotline filter on the same ferrite substrate.

In a preferred embodiment, the preselector filter is composed of a ferrite substrate having a microstrip transmission line traversing the length of one surface and a ground plane covering the other surface. The microstrip line is electrically connected to an input port at one end of the ferrite slab and an output port at the other end. The microstrip line incorporates a fixed-tuned multi-section bandpass filter using end-coupled or quarter-wave coupled resonators; this filter defines the preselector bandwidth. The ground plane implements a plurality of slot-line resonators located directly above the microstrip line in a region removed from the microstrip resonators. As a result, the multi-section microstrip bandpass filter and the slot-line band-reject resonators are located a distance from each other on opposite surfaces of the ferrite slab.

The slot-line resonators consist of slots etched directly in the metallic ground plane. Depending on the location and size of these slot resonators with respect to the microstrip line on the bottom surface of the ferrite slab, a predetermined frequency or band of frequencies can be excised from those frequencies that pass through the microstrip bandpass filter. This narrowband excision can be varied throughout the passband by applying a tunable magnetic bias field of appropriate strength and magnitude in a transverse direction to the ferrite substrate. As a result, the slot-line resonators form a tunable band rejection slotline filter within the same planar preselector having a fixed-tuned microstrip bandpass filter. Consequently, the present invention overcomes, to a large extent, the problems of size and cost that have beset the preselectors of the prior art.

These and other features of the invention are described in more complete detail in the following description of the preferred embodiment when taken with the drawings. The scope of the invention, however, is limited only by the claims appended hereto.

DETAILED DESCRIPTION OF THE INVENTION

Figure 1:
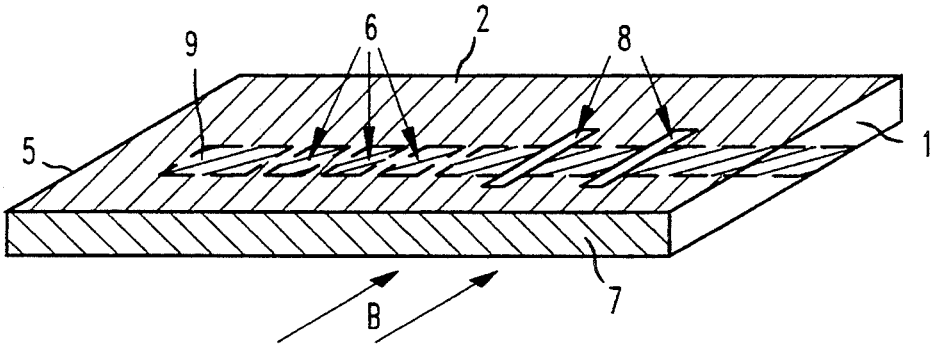
FIG. 1 is a three dimensional view of a preferred embodiment of the invention.

Referring now to FIG. 1 there is shown a preferred embodiment of the invention. As shown, ferrite substrate or substrate 7 has a top surface 2, a bottom surface (not shown), and end surfaces 1 and 5. Microstrip transmission line 9 traverses the length of the bottom surface (not shown) of substrate 7 and a ground plane (having a tunable band rejection slotline filter or slotline filter 8) that substantially covers top surface 2.

Microstrip transmission line 9 has a fixed-tuned wideband bandpass filter 6 located toward end surface 5 of substrate 1. Bandpass filter 6 is basically composed of short resonant elements of microstrip, having a length that is one-half the guide wavelength at the center frequency of the passband. As a result, bandpass filter 6 can be designed to pass any desired band of frequencies within a predetermined range, such as microwaves or millimeter-waves, by adjusting the length and size of the microstrip sections that comprise it.

Slotline filter 8, located on top surface 2, however, is basically a plurality of slotline resonators etched in the ground plane covering top surface 2. The slotline resonators act as band rejection elements in that they can be tuned to reject any narrowband of frequencies within the passband defined by bandpass filter 6. Essentially, depending on the positioning and size of the slotline resonators, slotline filter 8 can excise a predetermined narrowband within the passband of the preselector. In addition, since substrate 7 is a ferrite material, slotline filter 8 can be tuned by applying a variable magnetic bias field (not shown) transversely to substrate 7 such that the narrowband excision can be adjusted over a predetermined range of frequencies.

Figure 2:
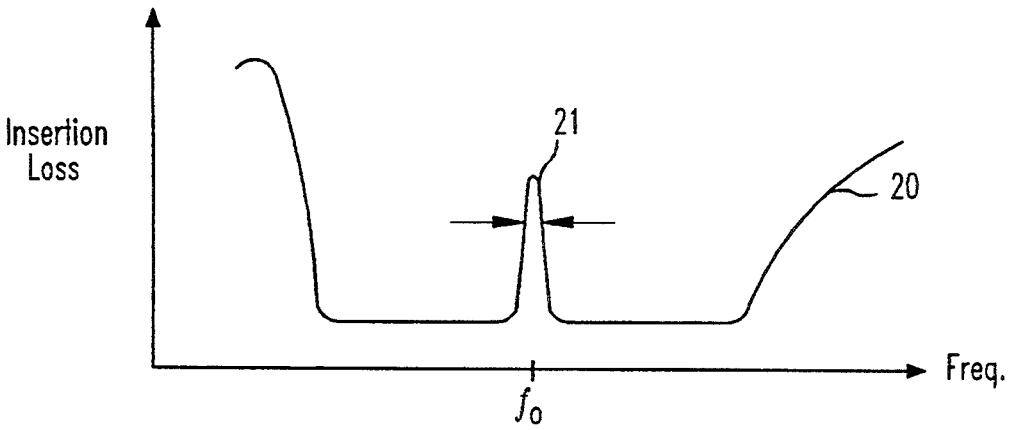
FIG. 2 is a graph of the insertion loss versus the frequency of the preferred embodiment shown in FIG. 1.

The overall insertion loss versus frequency of this embodiment is shown in FIG. 2. As shown, there is a nominal insertion loss for the frequencies within passband 20 as defined by bandpass filter 6. Moreover, there is a significant insertion loss for the narrowband of frequencies 21 centered around frequency "fo" which is defined by slotline filter 8. As a result, only the frequencies within passband 20 and outside narrowband 21 will pass through the entire preselector circuit with minimal loss.

In operation, a compatible microwave or millimeter-wave integrated circuit can be attached to substrate 7 at end surface 5 and end surface 1 such that microwaves or millimeter-signals can travel trough microstrip 9 in a direction from end surface 5 to end surface 1. As microwaves or millimeter signals pass through microstrip 9, bandpass filter 6 will only pass those frequencies within its passband 20. Of those frequencies that pass through bandpass filter 6, slotline filter 8 will suppress or excise a narrowband 21 as determined by a magnetic biasing field (not shown) applied in a transverse direction to substrate 7 across slotline filter 8. As a result, only those frequencies inside passband 20 and outside narrowband 21 will flow through the entire preselector circuit. Consequently, the present invention overcomes to a large extent the problems and limitations that have beset the prior art (i.e. size, weight, cost and IC compatibility).

What is claimed is:

1. A planar microwave/millimeter-wave preselector with tunable narrowband excision, comprising:

a ferrite substrate having a first and a second opposing surface, and a first and a second end;

a microstrip line traversing the length of said first surface of said substrate from said first end to said second end, said microstrip having a fixed-tuned bandpass filter located substantially toward said first end of said substrate, said bandpass filter fixed-tuned to a predetermined passband;

a ground plane substantially covering said second surface of said substrate; and a plurality of tunable slot-line resonators etched in said ground plane substantially toward said second end of said substrate, said plurality of slot-line resonators comprising a tunable band-rejection slot-line filter for excising a predetermined narrowband of frequencies within said predetermined passband, said slotline resonators tunable by the application of a tunable magnetic field bias, having a predetermined strength and direction, transversely across said ferrite substrate.

2. The preselector of claim 1 wherein said fixed tuned bandpass filter is comprised of a plurality of resonant elements of microstrip having a length that is one-half the guide wavelength at the center frequency of said predetermined passband.

3. The preselector of claim 2 wherein said resonant elements of microstrip are arranged in an end-coupled formation.

4. The preselector of claim 2 wherein said resonant elements of microstrip are arranged in a quarter-wave formation.

* * * * *